United States Patent [19]

Chen

[11] Patent Number: 4,932,649

[45] Date of Patent: Jun. 12, 1990

[54] FAN-TYPE EXERCISE BICYCLE WITH A HANDLEBAR FRICTION ASSEMBLY

[76] Inventor: Paul P. C. Chen, 12 Fl., No. 23, Lane 298, Lung Chiang Rd., Taipei, Taiwan

[21] Appl. No.: 410,934

[22] Filed: Sep. 22, 1989

[51] Int. Cl.[5] ..... A63B 21/00; A63B 21/22

[52] U.S. Cl. ..... 272/73; 272/97; 272/132

[58] Field of Search ..... 272/70, 72, 73, 131, 272/132, 97, DIG. 4, 116

[56] References Cited

U.S. PATENT DOCUMENTS 3,904,196 9/1975 Berlin ..... 272/132
4,618,139 10/1986 Haaheim ..... 272/132
4,657,244 4/1987 Ross ..... 272/73
4,824,102 4/1989 Lo ..... 272/73

*Primary Examiner*—Stephen R. Crow
*Attorney, Agent, or Firm*—Dellett, Smith-Hill & Bedell

[57] ABSTRACT

A fan-type exercise bicycle with adjustable resistance friction assemblies on the lower ends of its handlebars. Each friction assembly includes a knob with a bolt protruding from it, a two-piece casing, two friction pads and a friction plate which is clamped between the friction pads and the casing pieces. The bolt extends through the casing pieces and friction pads and through a curved slot in the friction plate. A threaded insert is fixed in a support stand of the fan-type bicycle. The threaded insert also protrudes slightly from the support stand so that the casing pieces are clamped between the knob and the threaded insert.

1 Claim, 4 Drawing Sheets

FAN-TYPE EXERCISE BICYCLE WITH A HANDLEBAR FRICTION ASSEMBLY

BACKGROUND OF THE INVENTION

This invention relates to an exercise bicycle and in particular relates to a fan-type exercise bicycle which has movable handlebars with a friction assembly at each lower end thereof. In the past, such fan-type exercise bicycles did not have movable handlebars. Other exercise bicycles (without fans) had movable handlebars, but they were connected mechanically to the pedaling system. Thus, there was no adjustability in the movement of the handlebars or in the resistance provided for the upper body. This limited the bicycle's functionability as far as exercising and limbering up the user's upper body were concerned.

It is the purpose of this invention, therefore, to mitigate and/or obviate the above-mentioned drawbacks in the manner set forth in the detailed description of the preferred embodiment.

SUMMARY OF THE INVENTION

A primary objective of this invention is to provide a fan-type exercise bicycle with a friction assembly on a handlebar portion thereof.

Another objective of this invention is to provide such a friction assembly which has adjustable resistance force.

A further objective of this invention is to provide such a friction assembly which is inexpensive to manufacture.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
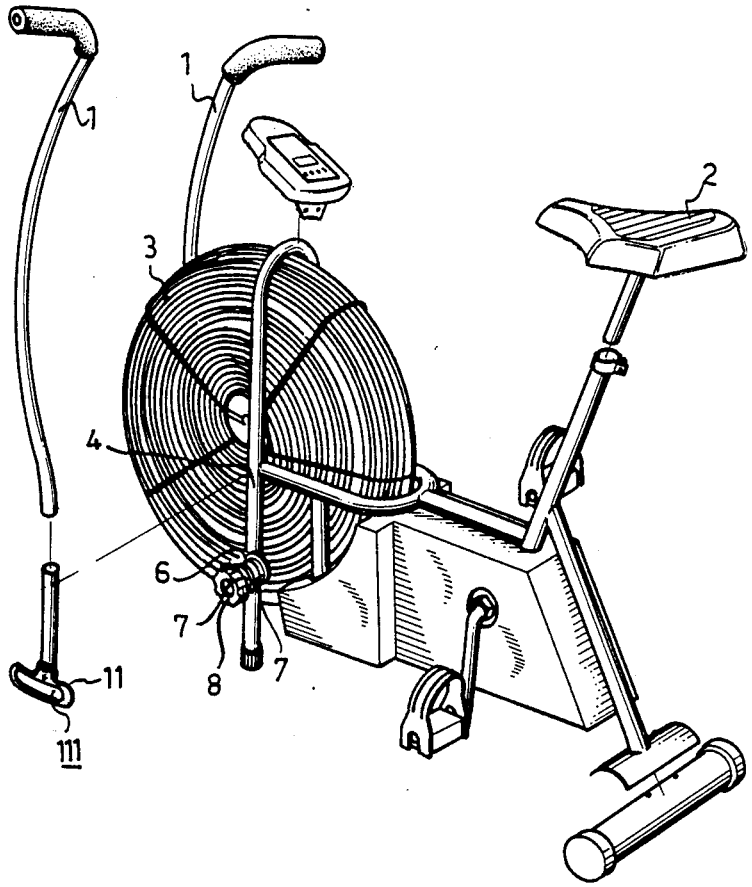
FIG. 1 is a partially exploded perspective view of a fan-type exercise bicycle with a handlebar friction assembly in accordance with the present invention.

Referring to FIG. 1, it can be seen that the present invention comprises a fan-type exercise bicycle with a wheel 3, a support stand 4, movable handlebars 1, a friction plate 11, annular friction pads 6, annular casing pieces 7, and a knob 8.

Figure 2:
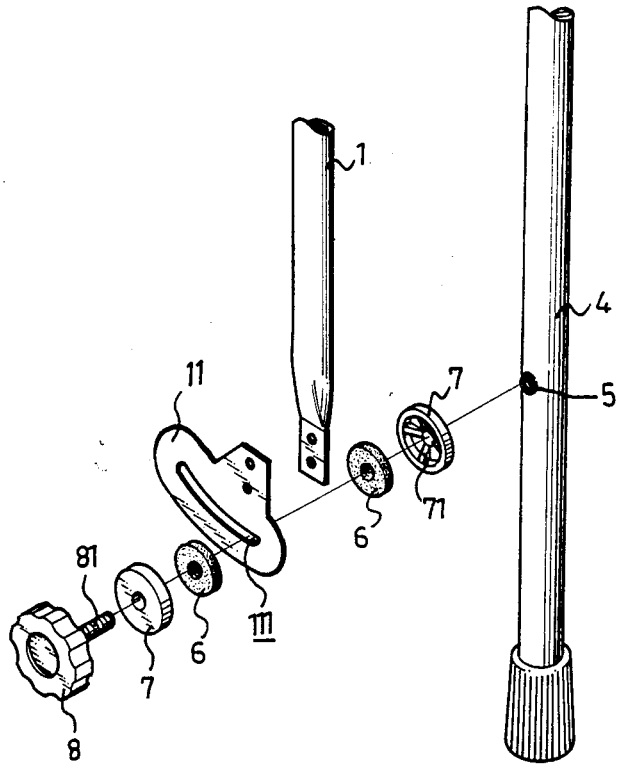
FIG. 2 is a cutaway exploded view of the handlebar friction assembly of FIG. 1.

FIG. 2 shows further details of a friction assembly, which includes the knob 8, the annular casing pieces 7, the annular friction pads 6, and the friction plate 11. The friction plate 11 has a curved slot 111 thereon. A bolt 81 protrudes from the knob 8 and passes through one of the casing pieces 7, one of the friction pads 6, the curved slot 111, the other friction pad 6 and the other casing piece 7, respectively. An inner surface at one end of each of the casing pieces 7 has a rim portion with a plurality of ribs 71 thereon for encompassing and firmly gripping the respective friction pad 6 and another end of each of the casing pieces 7 has a circular wall portion.

Figure 3:
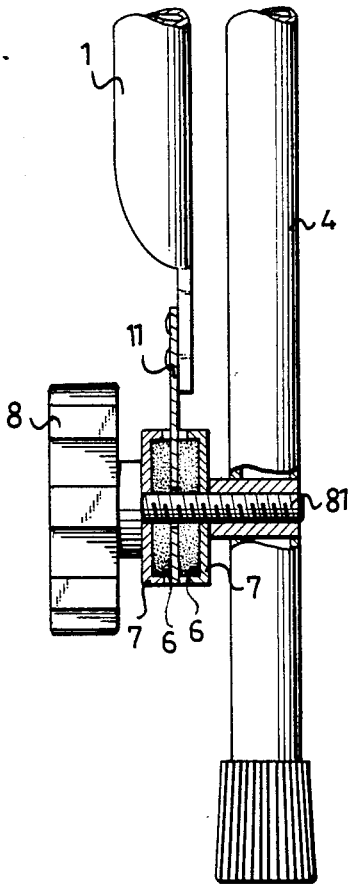
FIG. 3 is a cutaway cross-sectional view showing casing pieces, friction pads and a bolt of the handlebar friction assembly of FIG. 1.

Further referring to FIG. 3, it can be understood that when the knob 8 is tightened (turned clockwise), the bolt 81 is further received by a threaded insert 5 and the casing pieces 7 are clamped tighter and tighter between the knob 8 and the threaded insert 5. Since the wall of the casing piece 7 is made of a flexible material, as the knob 8 is tightened, the friction pads 6 are pushed against the friction plate 11, so as to increase the resistance which the user must overcome to move the handlebars 1.

Figure 4:
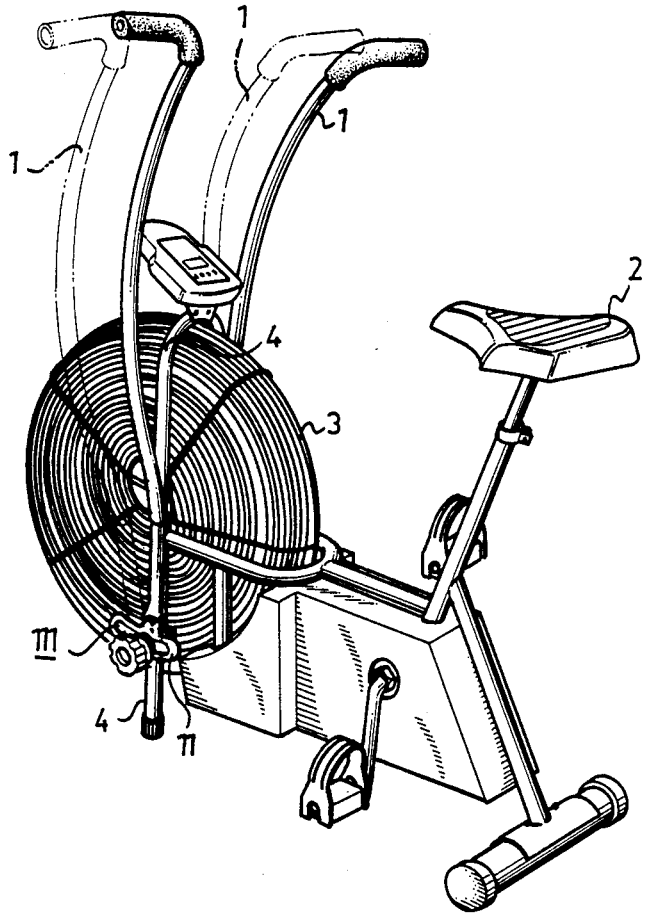
FIG. 4 is a perspective working view of the exercise bicycle with a handlebar friction assembly of FIG. 1.

Now referring to FIG. 4, a working view of the fan-type exercise bicycle with a handlebar friction assembly can be seen. As a user sits on a seat 2 of the exercise bicycle, he can simultaneously pedal and move the handlebars 1 back and forth. One of the key features of the present invention is that as the handlebars are not mechanically connected to the pedaling system, the user can adjust the frictional resistance of the handlebar friction assembly according to personal preference or need, totally separate from the speed of pedaling. This is especially helpful since the upper body strength and flexibility can vary to a great extent from person to person, especially between male and female users.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. A fan-type exercise bicycle comprising a handlebar and handlebar friction assembly, said friction assembly comprising:

a knob (8) with a bolt (81) protruding therefrom;

two annular casing pieces (7), each said annular casing pieces (7) having a circular wall portion, a rim portion and a plurality of ribs (71);

two annular friction pads (6), each said annular friction pad (6) being encompassed by said rim portion of each said annular casing piece (7);

a friction plate (11) which is fixed to a bottom end of said handlebar (1), said friction plate (11) having a curved slot (111) thereon so that said bolt (81) is passable therethrough, said friction plate (11) being positioned between said friction pads (6); and a threaded insert (5) being fixed in a lower end of a support stand (4) for receiving said bolt (81), said bolt (81) being tightenable in said threaded insert (5) pushing said two annular friction pads (6) against said friction plate, wherein the friction assembly provides variable resistance to handlebar pivoting (11).

* * * * *